US005309849A

United States Patent [19]

Krebs

[11] Patent Number: 5,309,849

[45] Date of Patent: May 10, 1994

[54] SLUDGE DRYING SYSTEM WITH RECYCLING EXHAUST AIR

[75] Inventor: Georg Krebs, Waldshut, Fed. Rep. of Germany

[73] Assignee: Andritz TCW Engineering GmbH, Waldshut-Tiengen, Fed. Rep. of Germany

[21] Appl. No.: 887,016

[22] Filed: May 22, 1992

[51] Int. Cl.[5] ..... F23G 5/04

[52] U.S. Cl. ..... 110/224; 110/238; 210/180; 422/176; 422/201

[58] Field of Search ..... 210/175, 180; 110/203, 110/211, 238, 224; 422/176, 201; 34/11, 12, 60

[56] References Cited

U.S. PATENT DOCUMENTS

| | | | |
|---|---|---|---|
| 1,915,240 | 6/1933 | Putnam | 210/667 |
| 2,090,187 | 8/1937 | Credo | 34/24 |
| 2,102,427 | 12/1937 | Lloyd et al. | 110/8 |
| 2,977,214 | 3/1961 | McLellan | 71/64 |
| 3,025,151 | 3/1962 | Berg et al. | 71/9 |
| 3,342,731 | 9/1967 | Baumann et al. | 210/45 |
| 3,410,233 | 11/1968 | Seiler | 110/15 |
| 3,548,510 | 12/1970 | Nakai et al. | 34/19 |
| 3,707,774 | 1/1973 | Eise et al. | 34/14 |
| 3,864,841 | 2/1975 | Mc Gehee | 34/11 |
| 3,954,069 | 5/1976 | Loker | 110/8 R |
| 3,963,471 | 6/1976 | Hampton | 71/12 |
| 4,040,190 | 8/1977 | Van dan Broek | 34/11 |
| 4,125,637 | 8/1980 | Lombana | 110/225 |
| 4,130,945 | 12/1978 | Brachthäuser | 34/10 |
| 4,153,411 | 5/1979 | Isheim | 432/27 |
| 4,245,396 | 1/1981 | Maffet | 34/12 |
| 4,357,152 | 11/1982 | Duske et al. | 55/257 C |
| 4,429,643 | 2/1984 | Mulholland | 110/238 |
| 4,558,525 | 12/1985 | Duske et al. | 34/128 |
| 4,761,893 | 8/1988 | Glorioso | 34/11 |
| 4,829,678 | 5/1989 | Glorioso | 34/11 |
| 4,852,269 | 8/1989 | Glorioso | 34/11 |
| 4,860,671 | 8/1989 | Glorioso | 110/236 |
| 4,901,654 | 2/1990 | Albertson et al. | 110/346 |
| 4,926,764 | 5/1990 | Van der Broek | 110/221 |
| 4,953,478 | 9/1990 | Glorioso | 110/215 |
| 4,956,926 | 9/1990 | Glorioso | 34/11 |
| 4,989,344 | 2/1991 | Glorioso | 34/111 |
| 5,069,801 | 12/1991 | Girovich | 210/770 |
| 5,200,155 | 4/1993 | Obrmueller | 110/203 |

OTHER PUBLICATIONS

TCW Brochure-Recycling of Organic Waste, 1984.

Knapp, "City Reads Income from Skludge Processing System", Public Works, Oct. 1977, pp. 103-105 & 118.

U. Keller, VSA-Dokumentation, "Klarschlamm behandelr", Jan. 29 & 30, 1981, pp. 8.0-8.78.

*Primary Examiner*—Matthew O. Savage

*Attorney, Agent, or Firm*—Roylance, Abrams, Berdo & Goodman

[57] ABSTRACT

A sludge drying system using exhaust air from a furnace in a direct heat, rotary drum dryer to simultaneously dry and pelletize the sludge. The dried sludge particles exiting the dryer is entrained in the exhaust air. The sludge particles are separated from the exhaust air and then classified according to size. The exhaust air is treated in a treatment section, and then divided into two exhaust air streams or portions. A first portion of the exhaust air is discharged into the environment, while the second, larger portion of the exhaust air is recycled back to the furnace to be used to dry the sludge in the drier. In one embodiment, the exhaust air treatment section is provided with a spray condenser and a bio-filter. In another embodiment, the exhaust air treatment section is provided with a heat exchanger for exhaust air. In yet another embodiment, the exhaust air treatment section is provided with a heat exchanger for the cooling water of the condenser as well as a heat exchanger for the recycled exhaust air. In still another embodiment, the exhaust air treatment section is provided with a plurality of heat exchangers and the furnace is modified with an exhaust air deodorizing chamber.

36 Claims, 6 Drawing Sheets

SLUDGE DRYING SYSTEM WITH RECYCLING EXHAUST AIR

BACKGROUND OF THE INVENTION

1. Field of the Invention

This invention relates to removal of water from fibrous suspensions. More specifically, this invention relates to the treatment of exhaust air from a sludge drying system for producing granular particles or pellets to be used as fertilizer.

2. Description of the Prior Art

Sludge from a municipal wastewater treatment plant or a paper mill is mainly mechanically dewatered. This mechanically dewatered sludge is fed to a sludge drying plant which utilizes heated air in a rotating drying drum. The dried sludge is pelletized and can be either sold as fertilizer or disposed of as permitted by restricting regulations. The air discharged from the dryer, i.e., exhaust air, is cooled after separation from the sludge particles. A main portion of the exhaust air is recycled to the burner. The rest of the exhaust air is released into the atmosphere. If not further treated, the exhaust air released into the atmosphere will usually include unwanted organic particles which may accumulate during the drying process. This exhaust air may cause emission problems due to its odor and organic substance content which is being restricted to low concentrations.

It is known that such organic substances are inactivated at temperatures of above 800° C. and this has lead to the use of afterburners for removal from the exhaust air. Such system is disclosed in VSA—Dokumentation, "Klarschlamm behandeln" by U. Keller (1981). A process using afterburners will require additional energy to burn the exhaust air and expensive equipment to be added to the system. Also, the amount of exhaust air created by the entire sludge drying process will increase considerably.

Examples of other sludge drying systems are disclosed in U.S. Pat. Nos.: 3,410,233 to Seiler; 3,963,471 to Hampton; 4,761,893 to Glorioso; 4,901,654 to Albertson et al; 4,926,764 to van den Broek; 4,953,478 to Glorioso; and 5,069,801 to Girovich, all of which are hereby incorporated herein by reference.

Such prior systems provide a wet scrubber and/or an afterburner for treating exhaust air, which require extensive modification to existing systems and have high operating costs.

A major cost factor of prior systems is a separate afterburner for burning the exhaust air containing the organic particles. The exhaust air is wet and loaded with particulates and other contaminants. Thus, the exhaust air is subjected to scrubbing and cooling to remove some of the particulates and water prior to the afterburner. This results in loss of heat from the exhaust air, which is reheated in the afterburner.

This invention addresses these problems in the art as well as other problems in the art which will be apparent to those skilled in the art once given this disclosure.

SUMMARY OF THE INVENTION

Surprisingly, it has been found that a sludge drying system can be efficiently operated by recycling exhaust air through heat exchangers to lower energy requirements. Moreover, it has been found that recycling the exhaust air through a special deodorizing chamber in the furnace prior to discharging the exhaust air eliminates the odor in the exhaust air.

A process of the present invention for drying sludge to produce granular sludge particles, comprises the steps of introducing a quantity of sludge into a drying zone; supplying hot exhaust air from a furnace zone to the drying zone for absorbing moisture from the sludge to dehydrate the sludge and to produce dried sludge particles; conveying the hot exhaust air with the dried sludge particles entrained therein from the drying zone to a separating zone; separating the hot exhaust air from the dried sludge particles in the separating zone; passing the hot exhaust air through a first heat exchange zone; washing and cooling the exhaust air exiting the first heat exchange zone; passing the previously washed and cooled exhaust air through the first heat exchange zone for transferring energy from the hot exhaust air to the washed and cooled exhaust air; discharging a first portion of the previously washed and cooled exhaust air; and recycling a second portion of the previously washed and cooled exhaust air to the furnace zone for reheating and using the second portion of the exhaust air in the step of supplying hot exhaust air to the drying zone.

Another process of the present invention for drying sludge to produce granular sludge particles comprises the steps of introducing a quantity of sludge into a drying zone; supplying hot exhaust air from a furnace zone to the drying zone for absorbing moisture from the sludge to dehydrate the sludge and to produce dried sludge particles; conveying the hot exhaust air with the dried sludge particles entrained therein from the drying zone to a separating zone; separating the hot exhaust air from the dried sludge particles in the separating zone; washing and cooling the hot exhaust air utilizing a coolant; recycling the coolant through a first heat exchange zone for recooling the coolant and then using the recycled coolant in the step of washing and cooling the hot exhaust air; discharging a first portion of the washed and cooled exhaust air; and recycling a second portion of the washed and cooled exhaust air to the furnace zone for reheating and using the second portion of the exhaust air in the step of supplying hot exhaust air to the drying zone.

A furnace assembly for use with a sludge drying system of the present invention and other sludge drying systems comprises a housing, a burner coupled to the housing for producing a flame within the housing to heat the recycled exhaust air, and a deodorizing chamber for deodorizing exhaust air to be discharged to the environment.

The furnace housing has an exhaust air chamber, an inlet for providing recycled exhaust air into the exhaust air chamber, and an outlet for discharging hot exhaust air from the exhaust air chamber to a dryer. The deodorizing chamber has an inlet for providing exhaust air into the deodorizing chamber, an outlet for discharging exhaust air from the deodorizing chamber to the environment, and a passageway extending between the deodorizing chamber's inlet and the deodorizing chamber's outlet for maintaining the exhaust air passing through the deodorizing chamber for a predetermined period of time. The deodorizing chamber is positioned within the housing adjacent the flame produced by the burner to heat the exhaust air passing through the deodorizing chamber.

BRIEF DESCRIPTION OF THE DRAWINGS

Referring to the drawings which form part of this disclosure.

DETAILED DESCRIPTION OF THE INVENTION

Figure 1:
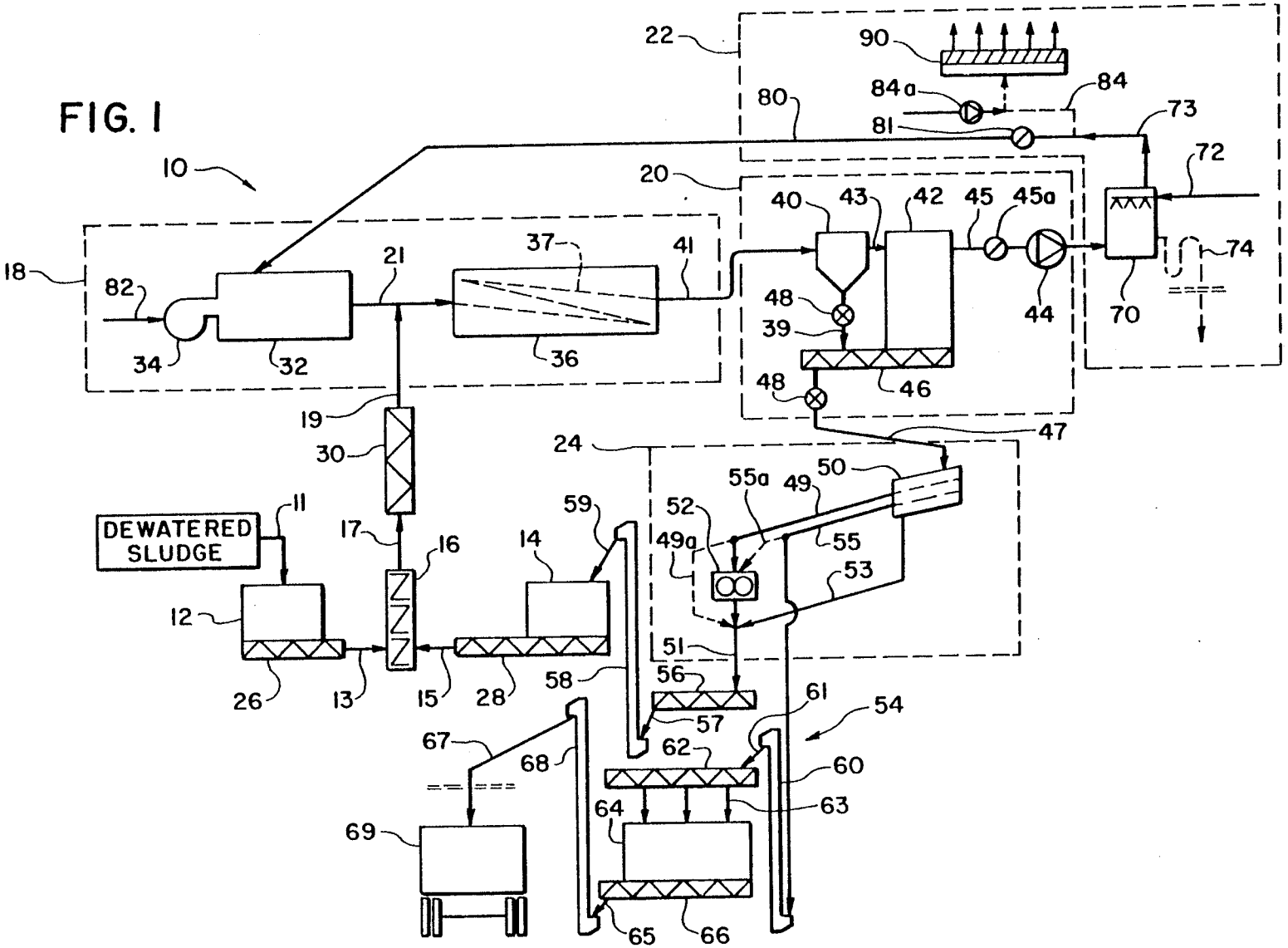
FIG. 1 is a schematic of a sludge drying plant or system with recycling of exhaust air in accordance with a first embodiment of the invention.

Although specific terms are used in the following description for the sake of clarity, these terms are intended to refer only to the particular structure of the invention selected for illustration in the drawings and are not intended to define or limit the scope of the invention.

Referring now to the drawings, a sludge drying plant or system 10 is shown in FIG. 1 in accordance with a first embodiment of the invention. Sludge drying plant 10 includes wet material silo 12 for receiving mechanically dewatered sludge discharged from a press or centrifuge and introduced into silo 12 by line or duct 11, base material silo 14 for receiving dried particles of sludge produced by plant 10, mixer 16 for mixing wet sludge with dried sludge particles conveyed from silos 12 and 14 by means of lines 13 and 15, drying and pelletizing section 18 for drying the sludge mixture of wet and dried sludge, an air-solids separation section 20 coupled to the drying section 18 for removing the solids or sludge particles from the exhaust air or off-gases from drying and pelletizing section 18, exhaust air treatment section 22 for treating the exhaust air from air-solids separation section 20, and classifying section 24 for separating the dried sludge particles according to size.

Liquid sludge from municipal wastewater treatment plants, pulp and paper mills, oil refineries, food processing plants, or pharmaceutical manufacturing plants is mechanically dewatered to form filter cakes. The dewatered sludge is fed into wet material silo 12 of sludge drying plant 10 by means of line 11. This wet material or wet sludge is then fed via metering screw conveyor 26 and line 13 into mixer 16 where the wet sludge mixes with thermally dried sludge particles from base material silo 14 conveyed to mixer 16 by metering screw conveyor 28 and line 15. The sludge mixture of wet and dried sludge is then conveyed to drying section 18 by means of line 17, screw conveyor 30 and line 19.

Drying section 18 includes furnace 32 with burner 34 coupled thereto and rotary drum dryer 36. The hot exhaust air discharged from furnace 32 and the sludge mixture of wet and dried sludge material conveyed by line 19 are introduced by means of line 21 into dryer 36 for removing moisture from the sludge to pelletize the sludge. The moisture from the sludge is absorbed into the hot exhaust air conveyed into dryer 36 from furnace 32. Dryer 36 is preferably a triple pass, rotary drum dryer with the sludge passing therethrough as schematically shown by line 37. The hot exhaust air from furnace 32 is introduced into dryer 36 at a temperature between about 250° C. and about 500° C., preferably up to 450° C., and at a pressure between about −20 mm WC and about −5 mm WC, preferably −10 mm WC. These pressures and other pressures discussed below are expressed in mm WC (millimeters-water column) with (−) indicating a pressure below atmospheric pressure and (+) indicating a pressure above atmospheric pressure.

The dried sludge particles are then discharged from dryer 36 together with hot, wet exhaust air or off-gases by means of line 41, and introduced into air-solids separation section 20 for separating the exhaust air from the sludge particles. The temperature of the exhaust air exiting dryer 36 ranges between about 75° C. and about 100° C., preferably about 90° C. The pressure of the exhaust air exits dryer 36 at a pressure between about −100 mm WC and about −150 mm WC, preferably −130 mm WC.

Separation section 20 includes preseparator 40 fluidly coupled to dryer 36 by means of line 41, polycyclone 42 fluidly coupled to preseparator 40 by means of line 43, and feed ventilator or fan 44 fluidly coupled to polycyclone 42 by means of line 45. A valve **45*a*, such as a flap valve, can be positioned in line 45** to regulate air flow and/or air pressure.

Preseparator 40 separates the heavy particles from the exhaust air stream or off-gases exiting dryer 36 via line 41. The exhaust air is discharged from preseparator 40 by means of line 43, while the dried particles are discharged by means of line 39. The exhaust air stream is then conveyed through line 43 to polycyclone 42 for further separation of any remaining dried sludge particles from the exhaust air. The exhaust air exiting polycyclone 42 is nearly completely free of dried sludge particles. Instead or in addition to the polycyclone 42, a textile filter (not shown) can be used for removing the remaining dried sludge particles in the exhaust air exiting preseparator 40 by means of line 43.

The dried sludge particles are then fed from preseparator 40 and polycyclone 42 to classifying section 24 by means of line 39, delivery screw conveyor 46 and line 47. Cellular sluices 48 are provided in lines 39 and 47 for controlling the flow of dried sludge particles through lines 39 and 47 and for preventing exhaust air from preseparator 40 and polycyclone 42 from entering classifying section 24.

Classifying section 24 includes sieve or classifying screen 50 and crusher or grinding mill 52. Specifically, the dried sludge particles from separation section 20 are fed to screen 50 by means of line 39, delivery screw conveyor 46, line 47 and through cellular sluices 48.

Screen 50 sorts or classifies the dried sludge particles into three size categories. The coarse material or oversized particles are discharged from screen 50 by means of line 49 and sent to grinding mill 52. After crushing the oversized particles into fines, the crushed particles are discharged from mill 52 by means of line 51.

The undersized particles are discharged from screen 50 by means of line 53, and introduced into line 51 for mixing with the crushed particles exiting mill 52 via line 51. The undersized particles and crushed particles are then sent to base material silo 14 for recycling via conveyor 56 and elevator 58. Specifically, the particles to be recycled are fed via feeding screw conveyor 56 by means of line 57 to elevator 58 and then into base material silo 14 by means of line 59.

The medium-sized particles or granulates discharged from screen 50 by means of line 55 are the final product with virtually no dust contained therein. The medium-sized particles can be delivered to vehicle 69 via conveyor and storing system 54.

Alternatively, the oversized particles can bypass mill 52 by means of line **49*a* and introduced into line 51 for recycling. Also, the medium-sized particles can be sent to mill 52 by means of line 55*a*** if more base material is needed.

Conveyor and storing system 54 includes elevator 60, screw conveyor 62, storing bin 64, screw conveyor 66, and elevator 68. Line 55 discharges the medium-size particles into elevator 60 which in turn conveys the medium-size particles to screw conveyor 62 via line 61. Screw conveyor 62 discharges the medium-size particles into storing bin 64 by means of lines 63. Then, screw conveyor 66 discharges the medium-size particles by means of line 65 to elevator 68, which in turn conveys the medium-size particles to vehicle 69 by means of line 67.

Following the air stream exiting polycyclone 42 via line 45, the hot, wet exhaust air passes through ventilator 44 in line 45 to the exhaust air treatment section 22. Specifically, the hot, wet exhaust air is forced through line 45 into spray condenser 70 by ventilator 44. Spray condenser 70 washes and cools the hot, wet exhaust air by introducing a coolant such as cooling water into spray condenser 70 via duct 72. The water particles in the hot, wet exhaust air are then condensated and discharged from spray condenser 70 together with the cooling water via outlet line or duct 74. The washed and cooled dry exhaust air exits condenser 70 by means of line 73, and is then divided into two exhaust air streams or portions by means of lines 80 and 84 and by a conventional valve or proportioning mechanism. A valve 81 in line 80 regulates the air flow and the air pressure of the exhaust air therethrough.

The hot, wet exhaust air enters condenser 70 by means of line 45 at a temperature between about 75° C. and about 100° C., preferably about 90° C., and at a pressure between about −250 mm WC and about −320 mm WC, preferably −280 mm WC. The washed and cooled exhaust air exits condenser 70 by means of line 73 at a temperature between about 45° C. and about 70° C., preferably 55° C., and at a pressure between about +60 mm WC and about +100 mm WC, preferably +80 mm WC.

The larger portion of the exhaust air stream in line 80 is recycled to furnace 32. Preferably, a volume of about 90% of the exhaust air exiting spray condenser 70 is recycled. In furnace 32, the recycled exhaust air is mixed with fresh air entering furnace 32 from duct 82 of burner 34. The mixture of fresh air and recycled exhaust air is then reheated in furnace 32 and conveyed through line 21 to dryer 36 for drying the sludge mixture in dryer 36. Specifically, the washed and cooled exhaust air enters furnace 32 by means of line 80 at a temperature between about 45° C. and about 70° C., preferably 55° C., and at a pressure between about ±0 mm WC and about −10 mm WC, preferably −5 mm WC. The recycled and reheated exhaust air exits furnace 32 by means of line 21 at a temperature between about 250° C. and about 500° C., preferably up to 450° C., and at a pressure between about −20 mm WC and about −5 mm WC, preferably −10 mm WC.

The smaller portion of the exhaust air exiting spray condenser 70 of the exhaust is released to the environment through duct or line 84. Preferably, a volume of about 10% of the exhaust air exiting spray condenser 70 is discharged to the environment. The exhaust air exiting through duct 84 may still contain some organic particles which might not meet environmental regulations because of their odor.

To treat the odor in the exhaust air to be discharged through duct 84, an additional bio-filter 90 can be provided on duct 84 to keep the organic particles from being discharged in the environment. The washed and cooled exhaust air and cooling air added by ventilator **84*a* exit bio-filter 90** into the environment at a temperature between about 20° C. and about 40° C., preferably 30° C., and at a pressure between about ±0 mm WC and about +40 mm WC, preferably 20 mm WC.

The division of the exhaust air streams between recycling duct 80 and discharging duct 84 can range from a volume percent ratio of recycled exhaust air to discharged exhaust air of from about 65:35 to about 95:5. Preferably, the ratio of recycled exhaust air to the discharged exhaust air is a volume percent ratio in the range of from about 80:20 up to about 95:5. Based on testing, a volume percent ratio of about 90:10 appears to be the optimum ratio for the recycled exhaust air to the discharged exhaust air.

Figure 2:
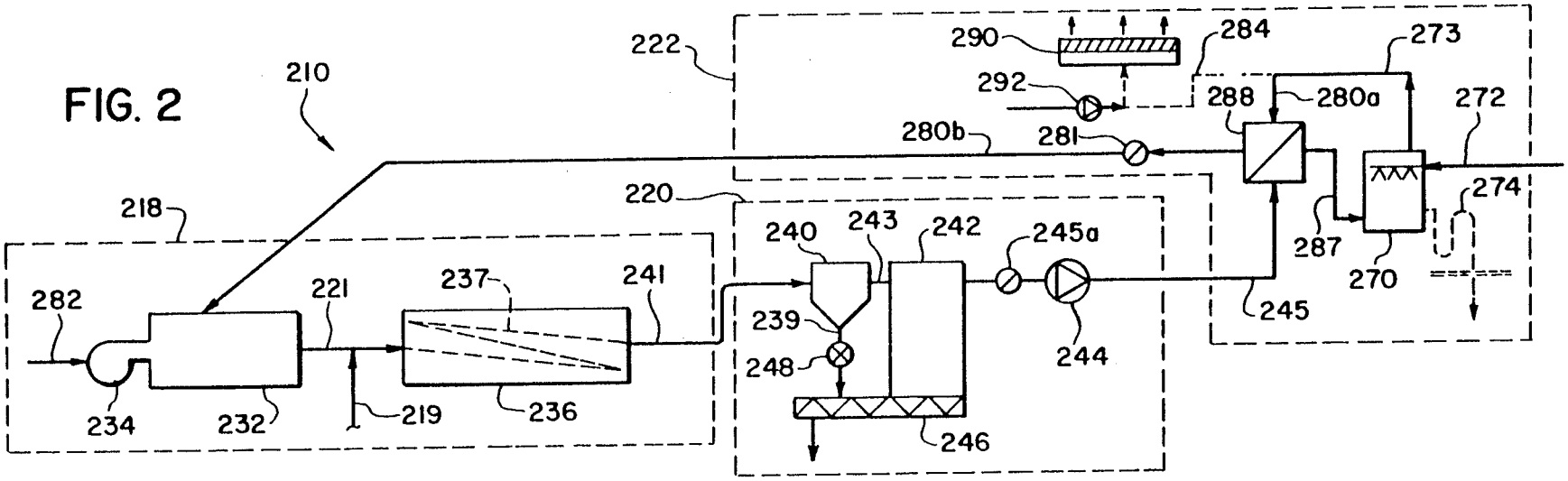
FIG. 2 is a partial, schematic of a sludge drying plant or system with recycling of exhaust air in accordance with a second embodiment of the invention.

Exhaust Air Treatment Section of FIG. 2

Another embodiment of the present invention for treating exhaust air from dryer 236 is shown in FIG. 2 where a second sludge drying system 210 is illustrated. Treatment of the dried sludge particles and the wet sludge in this embodiment is the same as discussed above in connection with first sludge drying system 10. Accordingly, only the treatment of the exhaust air and associated equipment will be illustrated in FIG. 2.

In system 210, hot exhaust air is discharged from furnace 232 by means of line 221 where it mixes with sludge mixture from line 219. The hot exhaust air and sludge mixture is discharged from line 221 into dryer 236. The hot exhaust air enters dryer 236 at a temperature between about 250° C. and 500° C., preferably up to 450° C., and at a pressure between about −20 mm WC and about −5 mm WC, preferably −10 mm WC. The sludge flows through dryer 236 as schematically shown by line 237. The hot exhaust air is discharged from dryer 236 into line 241 at a temperature between about 75° C. and about 100° C., preferably about 90° C., and at a pressure between about −100 mm WC and about −150 mm WC, preferably −130 mm WC.

Then the hot, wet exhaust air and dried sludge particles entrained therein are introduced into preseparator 240 by means of line 241. The hot, wet exhaust air is discharged from preseparator 240 by means of line 243, and introduced into polycyclone 242. The hot, wet exhaust air is then discharged from polycyclone 242 by means of line 245 with ventilator 244 and valve 245*a* therein. Valve 245*a* regulates the air flow and the air pressure in line 245. Specifically, ventilator 244 draws the exhaust air through dryer 236, line 241, preseparator 240, line 243, polycyclone 242 and line 245.

Heat exchanger 288 receives hot, wet exhaust air from line 245 exiting polycyclone 242 and/or a textile filter (not shown) via ventilator 244. Heat exchanger 288 partially cools the hot, wet exhaust air before entering spray condenser 270. Specifically, heat exchanger 288 uses the washed and cooled air from spray condenser 270 to partially cool the hot, wet air discharged from dryer 236. The hot, wet exhaust air enters heat exchanger 288 via line 245 at a temperature between about 75° C. and about 100° C., preferably 90° C., and at a pressure between about +180 mm WC and about +220 mm WC, preferably +200 mm WC. The partially cooled exhaust air exits heat exchangers 288 by means of line 287 at a temperature between about 65° C. and about 85° C., preferably 70° C., and at a pressure between about +140 mm WC and about +180 mm WC, preferably +160 mm WC.

In condenser 270, the exhaust air is washed and cooled by cooling water introduced into condenser 270 by means of line 272. The partially cooled exhaust air enters condenser 270 by means of line 287 at a temperature between about 65° C. and about 85° C., preferably 70° C., and at a pressure between about +140 mm WC and about +180 mm WC, preferably +160 mm WC. The washed and cooled exhaust air exits condenser 270 by means of line 273 at a temperature between about 45° C. and about 70° C., preferably 55° C., and at a pressure between about +60 mm WC and about +100 mm WC, preferably +80 mm WC.

The cooling water, on the other hand, enters condenser 270 by means of line 272 at a temperature between about 10° C. and about 45° C., preferably 20° C., and at a pressure between about 3.5 bars and about 5.0 bars, preferably 4.0 bars. The cooling water exits condenser 270 by means of line 274 at a temperature between about 40° C. and about 65° C., preferably 53° C., and at atmospheric pressure.

After leaving spray condenser 270, the washed and cooled exhaust air is divided into two exhaust air portions or streams by means of lines 280*a* and 284. The larger portion of the exhaust air stream passes back into heat exchanger 288 via duct 280*a* so as to be reheated by the hot, wet exhaust air entering heat exchanger 288 by line 245. Specifically, the washed and cooled exhaust air to be reheated enters heat exchanger 288 by means of line 280*a* at a temperature between about 45° C. and about 70° C., preferably 55° C., and at a pressure between about +60 mm WC and about +100 mm WC, preferably +80 mm WC. The reheated exhaust air exits heat exchanger 288 by means of line 280*b* at a temperature between about 55° C. and about 75° C., preferably 65° C., and at a pressure between about +45 mm WC and about +85 mm WC, preferably +65 mm WC.

Then, the reheated exhaust air exiting heat exchanger 288 is recycled to furnace 232 via duct 280*b*. The exhaust air to be reheated enters furnace 232 by means of line 280*b* at a temperature between about 55° C. and about 75° C., preferably 65° C., and at a pressure between about ±0 mm WC and about −10 mm WC, preferably −5 mm WC. A valve 281 regulates the air flow and the air pressure of exhaust air in line 280*b* to furnace 232. The exhaust air exits furnace 232 by means of line 221 at a temperature between about 250° C. and about 500° C., preferably up to 450° C., and at a pressure between about −20 mm WC and about −5 mm WC, preferably −10 mm WC.

The smaller portion of the exhaust air stream is released via line 284 into the environment. Ventilator 292 mixes a cooling air into line 284 to lower the temperature of the exhaust air. Prior to releasing the exhaust air to the environment, the exhaust air passes through a bio-filter 290. The exhaust air exits bio-filter 290 into the environment at a temperature between about 20° C. and about 40° C., preferably 30° C., and at a pressure between about ±0 mm WC and about +40 mm WC, preferably +20 mm WC.

Figure 3:
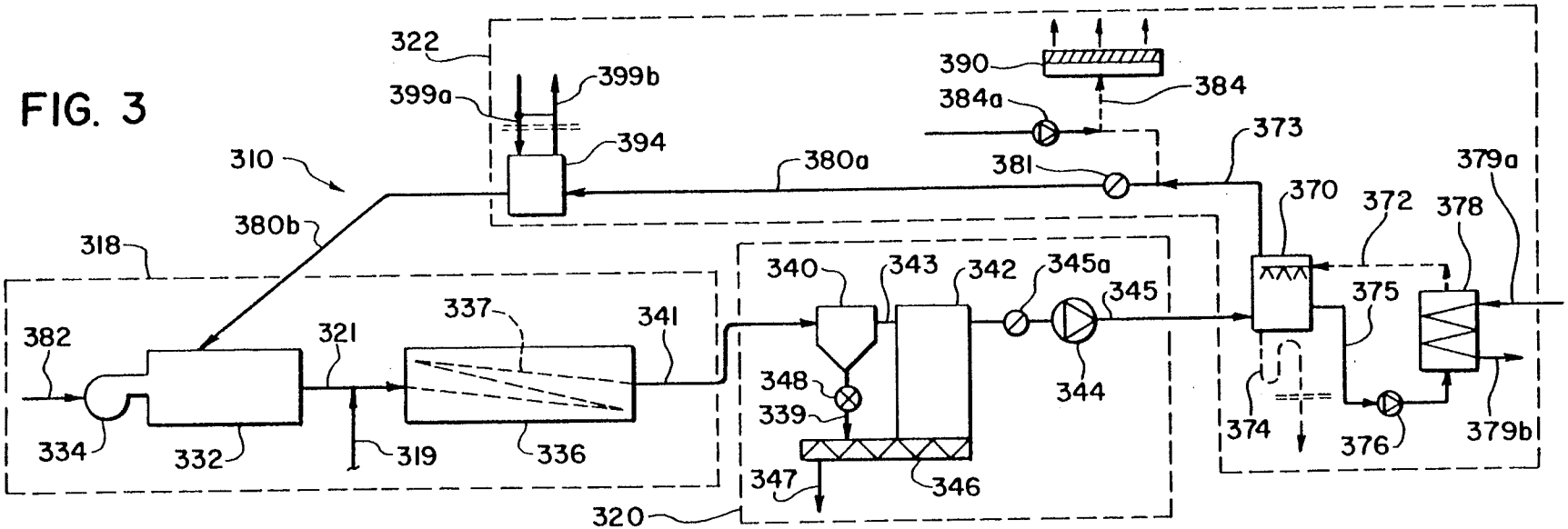
FIG. 3 is a partial, schematic of a sludge drying plant or system which shows a process with additional heat exchangers for optimizing the energy consumption.

Exhaust Air Treatment Section of FIG. 3

A third sludge drying system 310 of the present invention is illustrated in FIG. 3. Treatment of the dried sludge particles and the wet sludge in this system are treated in substantially the same manner as discussed above in the first sludge drying system 10 of FIG. 1. Accordingly, only the treatment of the exhaust and associated equipment will be illustrated in FIG. 3.

In third system 310, hot exhaust air is discharged from furnace 332 by means of line 321 where it mixes with sludge mixture from line 319. The hot exhaust air and sludge mixture is discharged from line 321 into dryer 336. The hot exhaust air enters dryer 336 at a temperature between about 250° C. and about 500° C., preferably up to 450° C., and at a pressure between about −20 mm WC and about −5 mm WC, preferably −10 mm WC. The sludge flows through dryer 336 as schematically shown by line 337. The hot exhaust air is discharged from dryer 336 into line 341 at a temperature between about 75° C. and about 100° C., preferably about 90° C., and at a pressure between about −100 mm WC and about −150 mm WC, preferably −130 mm WC.

Then, the hot, wet exhaust air and dried sludge particles entrained therein are introduced into preseparator 340 by means of line 341. The hot, wet exhaust air is discharged from preseparator 340 by means of line 343, and introduced into polycyclone 342. The hot, wet exhaust air is then discharged from polycyclone 342 by means of line 345 and ventilator 344. Valve 345*a* regulates the air flow and the air pressure of exhaust air in line 345. Specifically, ventilator 344 draws the exhaust air through dryer 336, line 341, preseparator 340, line 343, polycyclone 342 and line 345.

The hot, wet exhaust air is blown by ventilator 344 directly into the spray condenser 370 for washing and cooling the hot, wet exhaust air from dryer 336. This causes the cooling water of spray condenser 370 to be heated by the hot, wet exhaust air from polycyclone 342. The hot, wet exhaust air enters condenser 370 by means of line 345 at a temperature between about 75° C. and about 100° C., preferably 90° C., and at a pressure between about +190 mm WC and about +230 mm WC, preferably +210 mm WC. The washed and cooled exhaust air exits condenser 370 by means of line 373 at a temperature between about 45° C. and about 70° C., preferably 55° C., and at a pressure between about +110 mm WC and +150 mm WC, preferably +130 mm WC.

The cooling water enters condenser 370 by means of line 372 at a temperature between about 10° C. and about 45° C., preferably 20° C., and at a pressure between about 3.5 bars and about 5.0 bars, preferably 4.0 bars. The cooling water then exits condenser 370 by means of line 374 at a temperature between about 40° C. and about 65° C., preferably 53° C., and at atmospheric pressure. The heated cooling water exits spray condenser 370 by means of line 375 for recycling. Pump 376 pumps the heated cooling water from spray condenser 370 through line 375 to heat exchanger 378.

In heat exchanger 378, the heat from the heated cooling water is transferred to another cooling medium, e.g., water or thin liquid sludge, fed into heat exchanger 378 by means of line 379*a* and discharged by means of line 379*b*. Specifically, the cooling medium enters heat exchanger 378 by means of line 379*a* at a temperature between about 10° C. and about 30° C., preferably 15° C., and at a pressure between about 0.5 bars and about 4.0 bars, preferably 3.0 bars. The cooling medium exits heat exchanger 378 by means of line 379*b* at a temperature between about 30° C. and about 55° C., preferably 45° C., and at a pressure between about 0.4 bars and 3.5 bars, preferably 2.0 bars.

The recycled cooling water from heat exchanger 378 is then pumped through line 372 to spray condenser 370 for again cooling the hot, wet exhaust air in spray condenser 370 as previously discussed.

System 310 has the advantage that the large quantity of cooling water which is heated by the hot exhaust air to a considerably high temperature, i.e., 50°-60° C., does not have to be dumped, but the energy or heat from the cooling water can be utilized elsewhere in the system 310 to conserve energy. Only a small amount of condensate as overflow from the spray condenser 370 has to be discharged by means of outlet line 374. The amount of condensate discharged through line 374 typically corresponds to the amount of evaporated water from the sludge.

The washed and cooled exhaust air leaving spray condenser 370 by means of line 373 is then divided into discharge line 384 and recycling line 380*a*. Discharge line 384 releases the exhaust air cooled by fresh air of ventilator 384*a* to the environment. The exhaust air exits bio-filter 390 into the environment at a temperature between about 20° C. and about 40° C., preferably 30° C., an a pressure between about ±0 mm WC and about +50 mm WC, preferably +20 mm WC.

The recycling line 380*a* is fluidly coupled to heat exchanger 394. The exhaust air from line 380*a* can be preheated in a heat exchanger 394 before entering the furnace 332. The exhaust air enters heat exchanger 394 by means of line 380*a* at a temperature between about 45° C. and about 70° C., preferably 55° C., and at a pressure between about +50 mm WC and about +30 mm WC, preferably +40 mm WC. The preheated exhaust air exits heat exchanger 394 by means of line 380*b* at a temperature between about 80° and about 450° C., preferably 420° C., and at a pressure between about ±0 mm WC and −10 mm WC, preferably −5 mm WC. Valve 381 regulates the air flow and the air pressure of exhaust air through line 380*b*.

The heating medium, on the other hand, enters heat exchanger 394 by means of line 399*a* at a temperature between about 95° C. and about 800° C., preferably 500° C., and at a pressure between about 0.07 bars and about 42.0 bars, preferably 16.0 bars. The heating medium exits heat exchanger 394 by means of line 399*b* at a temperature between about 80° C. and about 250° C., preferably 180° C., and at a pressure between about 0.05 bars and about 2.0 bars, preferably 1.0 bars. The temperature ranges of the heating medium depend on the type of medium used, e.g., hot air, steam or thermal oil. The heat source to heat this heating medium can also be a waste heat source having the required temperature level.

Fresh air is brought into furnace 332 through fresh air duct or line 382 of burner 334 where the fresh air mixes with exhaust air entering furnace 332 via line 380*b*. This fresh air along with air leaking into furnace 332 corresponds to the amount of exhaust air released into the atmosphere via duct 384. The recycled exhaust air enters furnace 332 by means of line 380*b* at a temperature between about 80° C. and about 450° C., preferably 420° C., and at a pressure between about ±0 mm WC and about −10 mm WC, preferably −5 mm WC. The exhaust air exits furnace 332 by means of line 321 at a temperature between about 250° C. and about 500° C., preferably up to 450° C., and at a pressure between about −20 mm WC and about −5 mm WC, preferably −10 mm WC.

Figure 4:
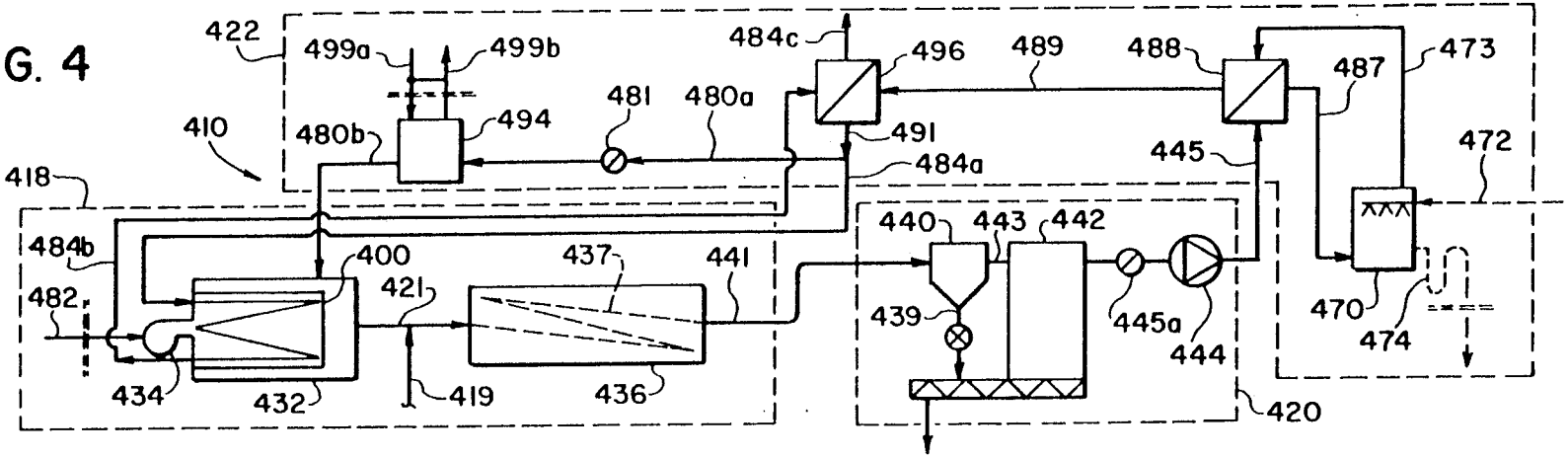
FIG. 4 shows a partial, schematic of a sludge drying plant or system according to the invention with treatment of the exhaust air.

Exhaust Air Treatment Section of FIG. 4

Another embodiment of the present invention is now described according to the invention as shown in FIG. 4. The dried sludge particles and wet sludge are handled the same way as described previously in connection with FIG. 1. Accordingly, only the treatment of the exhaust and associated equipment will be illustrated in FIG. 4.

In fourth system 410, hot exhaust air is discharged from furnace 432 by means of line 421 where it mixes with sludge mixture from line 419. The hot exhaust air and sludge mixture is discharged from line 421 into dryer 436. The hot exhaust air enters dryer 436 at a temperature between about 250° C. and about 500° C., preferably up to 450° C., and at a pressure between about −20 mm WC and about −5 mm WC, preferably −10 mm WC. The sludge flows through dryer 436 as schematically shown by line 437. The hot exhaust air is discharged from dryer 436 into line 441 at a temperature between about 75° C. and about 100° C., preferably about 90° C., and at a pressure between about −100 mm WC and about −150 mm WC, preferably −130 mm WC.

Then, the hot, wet exhaust air and dried sludge particles entrained therein are introduced into preseparator 440 by means of line 441. The hot, wet exhaust air is discharged from preseparator 440 by means of line 443, and introduced into polycyclone 442 and/or a textile filter (not shown). The hot, wet exhaust air is then discharged from polycyclone 442 by means of line 445 and ventilator 444. Valve 445*a* regulates the air flow and the air pressure of exhaust air in line 445. Specifically, ventilator 444 draws the exhaust air through dryer 436, line 441, preseparator 440, line 443, polycyclone 442 and line 445.

Accordingly, the hot, wet exhaust air is treated the same way as described and illustrated in FIG. 2, until it leaves heat exchanger 488. The hot, wet exhaust air to be partially cooled enters heat exchanger 488 by means of line 445 at a temperature between about 75° C. and about 100° C., preferably 90° C., and at a pressure between about +240 mm WC and about +280 mm WC, preferably +260 mm WC. The partially cooled exhaust air exits heat exchanger 488 by means of line 487 at a temperature between about 65° C. and about 85° C., preferably 70° C., and at a pressure between about +200 mm WC and about +240 mm WC, preferably +220 mm WC.

The washed and cooled exhaust air to be reheated, on the other hand, enters heat exchanger 488 by means of line 473 at a temperature between about 45° C. and about 70° C., preferably 55° C., and at a pressure between about +120 mm WC and about +160 mm WC, preferably +140 mm WC. The reheated exhaust air exits heat exchanger 488 by means of line 489 at a temperature between about 55° C. and about 75° C., preferably 65° C., and at a pressure between about +105 mm WC and about +145 mm WC, preferably +125 mm WC.

The partially cooled exhaust air enters condenser 470 by means of line 487 at a temperature between about 65° C. and about 85° C., preferably 70° C., and at a pressure between about 200 mm WC and about +240 mm WC, preferably +220 mm WC. The washed and cooled exhaust air exits condenser 470 by means of line 473 at a temperature between about 45° C. and about 70° C., preferably 55° C., and at a pressure between about +120 mm WC and about +160 mm WC, preferably +140 mm WC.

The cooling water, on the other hand, enters condenser 470 by means of line 472 at a temperature between about 10° C. and about 45° C., preferably 20° C., and at a pressure between about 3.5 bars and about 5.0 bars, preferably 4.0 bars. The cooling water exits condenser 470 by means of line 474 at a temperature between about 40° C. and about 65° C., preferably 53° C., and at atmospheric pressure.

The washed and cooled exhaust air exits heat exchanger 488 by means of line 489, and then passes through a second heat exchanger 496 for again heating the exhaust air. Preferably, heat exchanger 496 uses waste heat from system 410, such as the hot exhaust air discharged to the environment to conserve energy. The reheated exhaust air enters heat exchanger 496 by means of line 489 at a temperature between about 55° C. and about 75° C., preferably 65° C., and at a pressure between about +105 mm WC and about +145 mm WC, preferably +125 mm WC. The exhaust air exits heat exchanger 496 by means of line 491 at a temperature between about 115° C. and about 95° C., preferably 105° C., and at a pressure between about +90 mm WC and about +130 mm WC, preferably +110 mm WC.

The heated exhaust air to be released to the environment, on the other hand, enters heat exchanger 496 by means of line **484*b* at a temperature between about 750° C. and about 850° C., preferably 800° C., and at a pressure between about +40 mm WC and about +80 mm WC, preferably +60 mm WC. The heated exhaust air exits heat exchanger 496 by means of line 484*c* into the environment at a temperature between about 180° C. and about 200° C., preferably less than 200° C., and at a pressure between about ±0 mm WC and about +40 mm WC, preferably +20 mm WC. The flow rate of the exhaust air exiting heat exchanger 496** is between about 1000 $m^3/h$ and about 6000 $m^3/h$ depending upon the amount of evaporation of the water from the sludge.

Then, the exhaust air exiting heat exchanger 496 by means of line 491 is divided into two exhaust air streams or portions by means of lines **480*a* and 484*a* and by a conventional valve or proportioning mechanism. The larger stream or portion of the exhaust air exiting heat exchanger 496 flow through duct or line 480*a* to third heat exchanger 494. Valve 481 regulates the air flow and the air pressure in line 480*a*. The exhaust air to be recycled is preheated in heat exchanger 494 before being discharged to furnace 432 by means of line 480*b***.

The recycled exhaust air enters heat exchanger 494 by means of line **480*a* at a temperature between about 115° C. and about 95° C., preferably 105° C., and at a pressure between about +90 mm WC and about +130 mm WC, preferably +110 mm WC. The preheated, recycled exhaust air exits heat exchanger 494 by means of line 480*b*** at a temperature between about 80° C. and about 450° C., preferably 420° C., and at a pressure between about ±0 mm WC and about −10 mm WC, preferably −5 mm WC.

The heating medium, on the other hand, enters heat exchanger 494 by means of line **499*a* at a temperature between about 95° C. and about 800° C., preferably 500° C., and at a pressure between about 0.07 bars and about 42.0 bars, preferably 16.0 bars. The heating medium exits by means of line 499*b*** at a temperature between about 80° C. and about 250° C., preferably 180° C., and at a pressure between about 0.05 bars and about 2.0 bars, preferably 1.0 bars.

Exhaust air stream to be discharged to the environment is fed into deodorizing chamber 400 of the furnace 432 from line **484*a*, and heated by the burner 434 to a temperature of above 800° C. The exhaust air resides in deodorizing chamber 400 for a minimum of one second and advantageously approximately two seconds. These conditions (temperature of above 800° C. and residing time of approximately two seconds) of deodorizing chamber 400** guarantee that the organic substances in the exhaust air are inactivated and can be released into the environment without problems of odor.

The exhaust air stream leaves deodorizing chamber 400 of furnace 432 in duct **484*b* and is fed to second heat exchanger 496 via duct 484*b*. The exhaust air stream in duct 484*b* has a temperature of at least about 800° C. to pass its energy in heat exchanger 496 for preheating the previously washed and cooled exhaust air entering heat exchanger 496 via duct 489. The exhaust air entering heat exchanger 496 by means of line 484*b* is released into the environment via line 484*c*** at a temperature between about 180° C. and about 200° C., preferably less than 200° C., and at a pressure between about ±0 mm WC and about +40 mm WC, preferably +20 mm WC. With this system, many of the drawbacks of existing processes can be overcome with minimal additional apparatus and a maximum conservation of energy.

Figure 5:
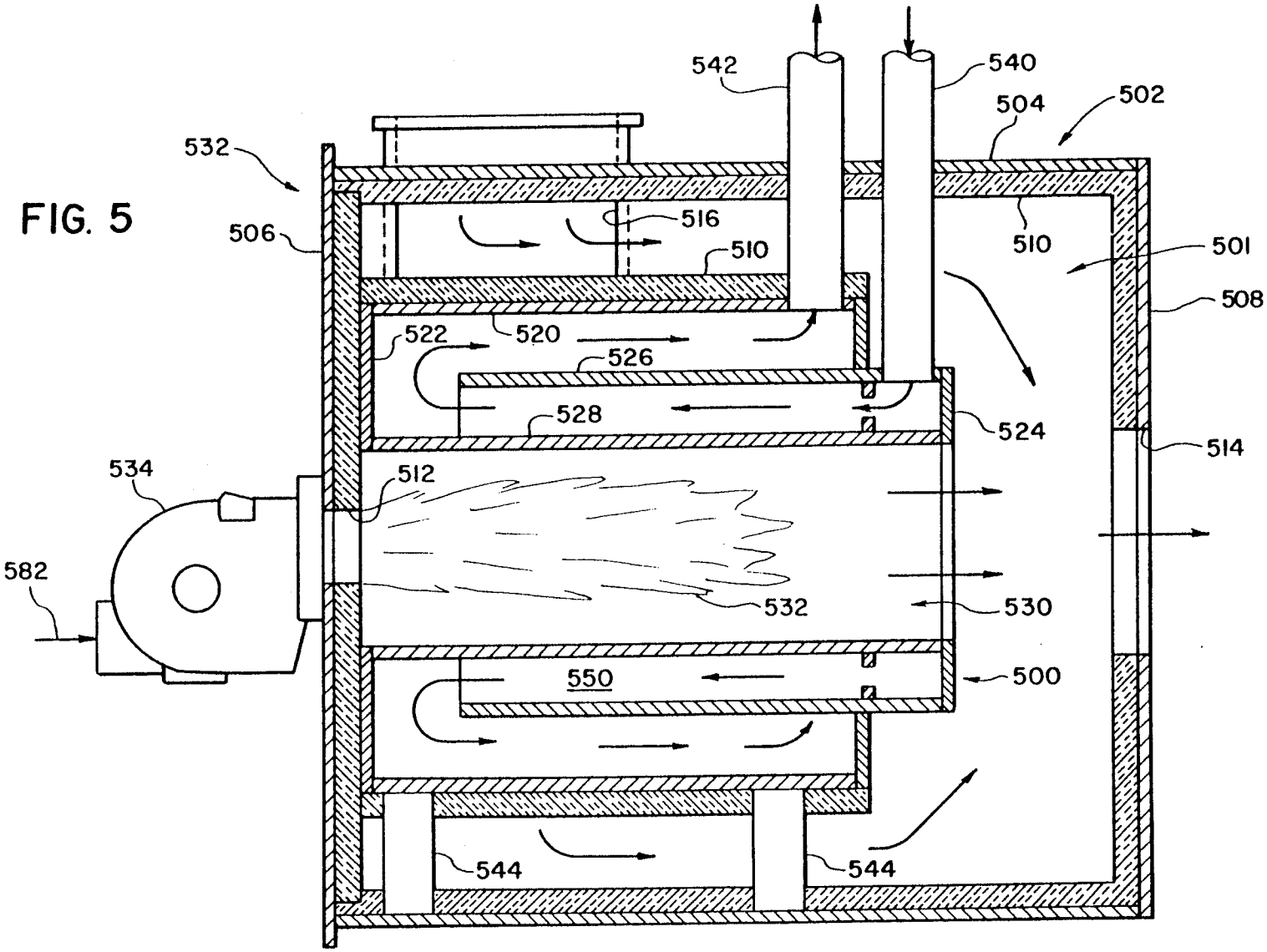
FIG. 5 is a longitudinal cross-sectional view of a first embodiment of a furnace with a burner coupled thereto, for use with the sludge drying system of FIG. 4 according to the invention.

Furnace of FIG. 5

Furnace 532 can be utilized in the sludge drying system 410 shown in FIG. 4 according to the invention. Furnace 532 has a built in deodorizing chamber 500 for receiving exhaust air prior to discharging the exhaust air to the environment, and exhaust air chamber 501 for recycling exhaust air to dryer 436. Specifically, furnace 532 has a cylindrical housing 502 which includes a cylindrical outer side wall 504, a first end wall 506, and a second end wall 508. The inner surfaces of walls 504, 506 and 508 of the furnace 532 are insulated with a layer of insulating material 510 to prevent loss of heat from furnace 532 to the environment.

First end wall 506 has a central, circular inlet opening 512 with burner 534 mounted thereto for receiving the flame end of burner 534 through opening 512. Second end wall 508 has a central, circular outlet opening 514 for discharging the hot exhaust air from furnace 532 to dryer 436. Side wall 504 has an exhaust air inlet 516 extending substantially tangentially thereto for continuously recycling exhaust air into furnace 532 and then to dryer 436 to dry the sludge mixture.

Deodorizing chamber 500 includes a cylindrical outer wall 520 rigidly coupled to side wall 504 of furnace 532, a first end wall 522 positioned adjacent burner 534, a second end wall 524, a cylindrical baffle 526, and a cylindrical inner wall 528. Also, deodorizing chamber 500 is insulated on the outer surface of outer wall 520 with a layer of insulating material 510.

The inner wall 528 of the deodorizing chamber 500 forms a tube 530 for the flame 532 of the burner 534. In deodorizing chamber 500 of the furnace 532, the hot burning gases are mixed with the recycled exhaust air stream fed into the furnace 532 through inlet 516. The mixture then is blown through the opening 514 via a pipe into the drying drum 436.

The portion of the exhaust air stream which is to be released into the environment is fed into the deodorizing chamber 500 via inlet pipe 540. Baffle 526 divides deodorizing chamber 500 into two concentric tubes so that the exhaust air first flows along the inner tube, and then back along the outer tube. Specifically, the exhaust air flows axially in the inner tube formed by baffle 526 and inner wall 528 to the front end near the burner 534. After at least one other turn, the exhaust air flows axially in an opposite direction along the outer tube formed by baffle 526 and outer wall 520. Then, the exhaust air is discharged via radially extending outlet pipe 542. This pipe 542 is connected with second heat exchanger 496 by means of line 484*b*, when furnace 532 is used with the system 410 of FIG. 4. The deodorizing chamber 500 is mounted to the side wall 504 of the furnace by radially extending support members 544.

The two concentric tubes of chamber 500 form a passageway 550 for heating the exhaust air to approximately 800° C. or greater. Passageway 550 is of sufficient length to provide a resident time for the exhaust air of one to two seconds at 800° C. or greater to destroy the odor therein.

With this design the recycled air is optimally used. The larger portion of the exhaust air, for example, 90% by volume of the total recycled air, is again used for drying the sludge. The rest of the exhaust air is heated up to above 800° C. to inactivate the organic substances in the exhaust air. To achieve this, no excess exhaust air is formed due to the necessity of fresh air in burner 534, and therefore no additional energy or fuel is necessary to heat this additional air.

Figure 7:
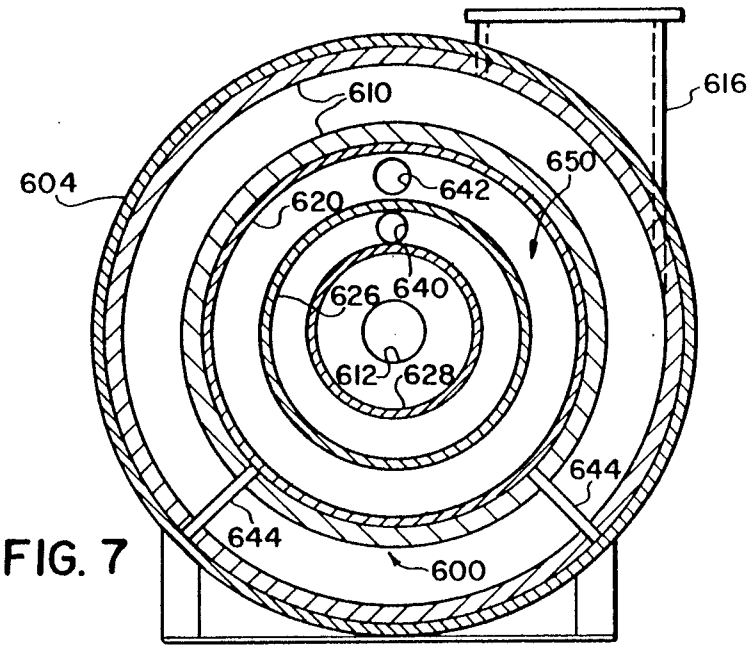
FIG. 7 is a transverse cross-sectional view of the furnace of FIG. 6 taken along line 7—7.
Figure 6:
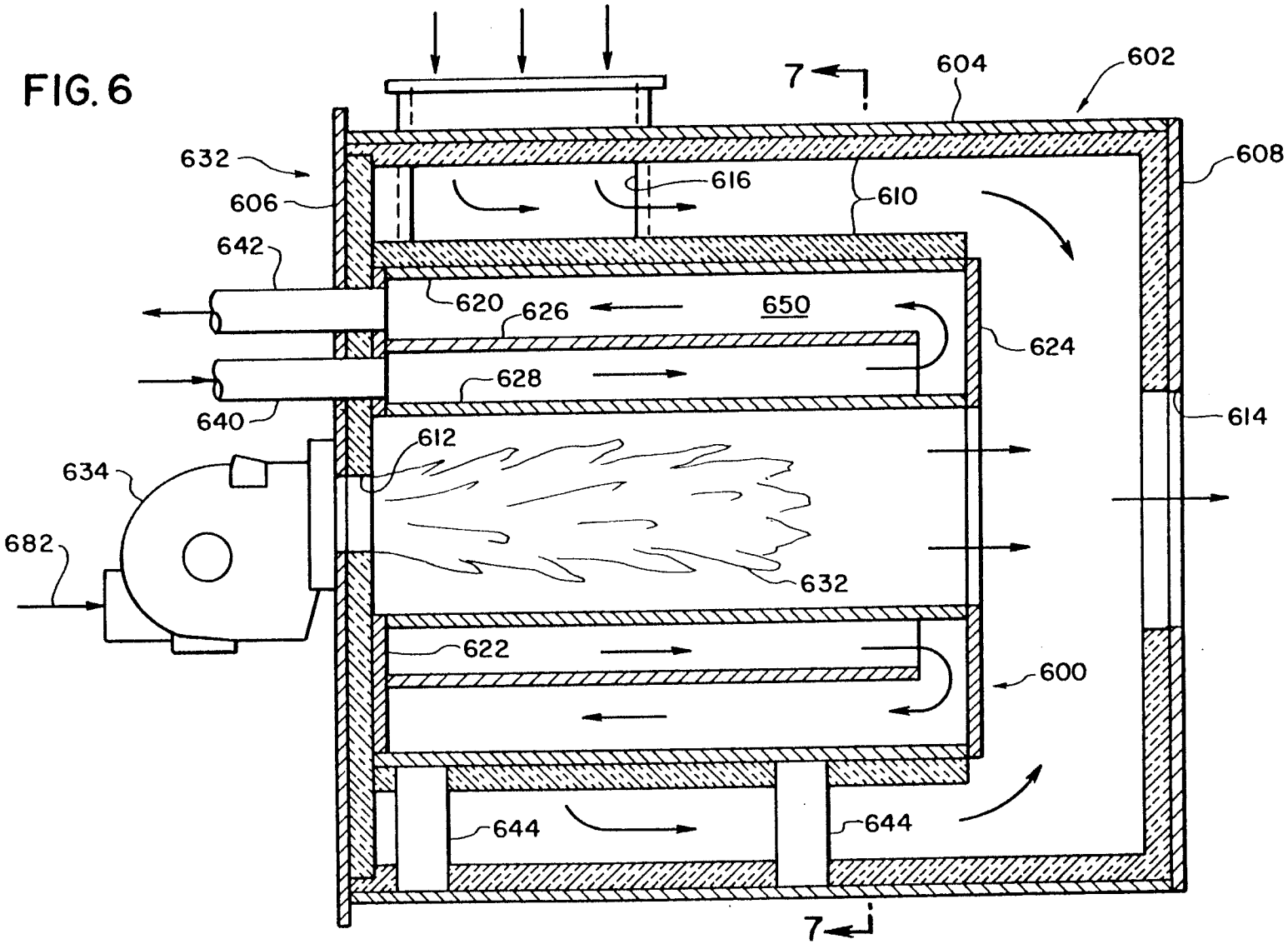
FIG. 6 is a longitudinal cross-sectional view of a second embodiment of a furnace with a burner coupled thereto according to the invention.

Furnace of FIGS. 6 and 7

FIG. 6 shows an alternative furnace 632 of the invention. The main difference between the furnace 532 of FIG. 5 and the furnace 632 of FIGS. 6 and 7 lies in the connections of the inlet and outlet pipes to the deodorizing chamber for the exhaust air stream to be discharged into the environment.

Furnace 632 has a cylindrical housing 602 which includes a cylindrical outer side wall 604, a first end wall 606, and a second end wall 608. The inner surfaces of walls 604, 606 and 608 of furnace 632 are insulated with a layer of insulating material 610 to prevent loss of heat from furnace 632 to the environment.

First end wall 606 has a central, cylindrical inlet opening 612 with burner 634 mounted thereto for receiving the flame end of burner 634 through opening 612. Second end wall 608 has a central, circular outlet opening 614 for discharging the hot exhaust air from furnace 632 to dryer 436 via duct work. Side wall 604 has an exhaust air inlet 616 extending substantially tangentially thereto for continuously recycling exhaust air into furnace 632 and then to dryer 436 to dry sludge.

Deodorizing chamber 600 includes a cylindrical outer wall 320 rigidly coupled to side wall 604 of furnace 632, a first end wall 622 positioned adjacent burner 634, a second end wall 624, a cylindrical baffle 626, and a cylindrical inner wall 628. Chamber 600 is also insulated on the outer surface of outer wall 620 with a layer of insulating material 610 to prevent heat loss.

In this case, the inlet pipe 640 is mounted axially. The exhaust air first flows along a tube formed by inner wall 628 and baffle 626, and then turns and flows again axially along a second tube formed by the baffle 626 and outer wall 620 to the outlet pipe 642. In this configuration, the thermal expansion of the exhaust air can be handled more easily.

There are also other possible alternatives of mounting the inlet and outlet pipes to the deodorizing chamber. For example, the flow direction can be modified such that one of the pipes 640 or 642, or both of them can be mounted near the bottom of the furnace 632.

As seen in FIG. 7, furnace 632 is substantially cylindrical with deodorizing chamber 600 concentrically mounted therein. The central opening 612 is the opening for the flame of burner 634. Surrounding the flame of burner 634 is deodorizing chamber 600. Specifically, the concentric, cylindrical walls 620 and 628 form a tube surrounding the flame of burner 634 for heating the exhaust air to be discharged to the environment. Baffle 626 divides deodorizing chamber 600 into two concentric tubes so that the exhaust air first flows along the inner tube, and then back along the outer tube. Thus, the two concentric tubes form a passageway 650 for heating the exhaust air to be discharged to approximately 800° C. or greater. Also, passageway 650 should have a length to provide a resident time for the exhaust air of one to two seconds at 800° C. or greater to destroy the odor therein. These tubes are connected to the inlet and outlet pipes 640 and 642 for conveying the exhaust air stream to be discharged to the environment through chamber 600 to destroy the odor in the exhaust air.

Figure 9:
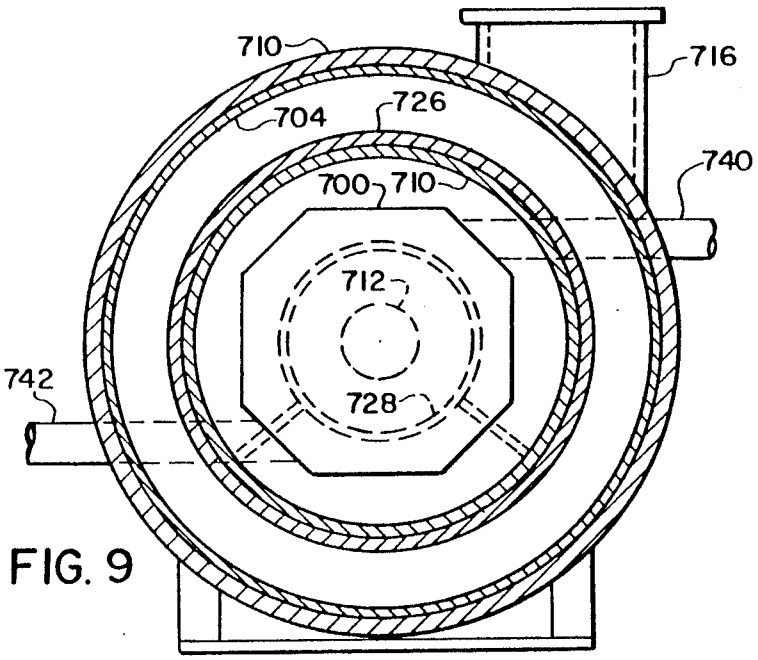
FIG. 9 is a transverse cross-sectional view of the furnace of FIG. 8 taken along line 9—9.
Figure 8:
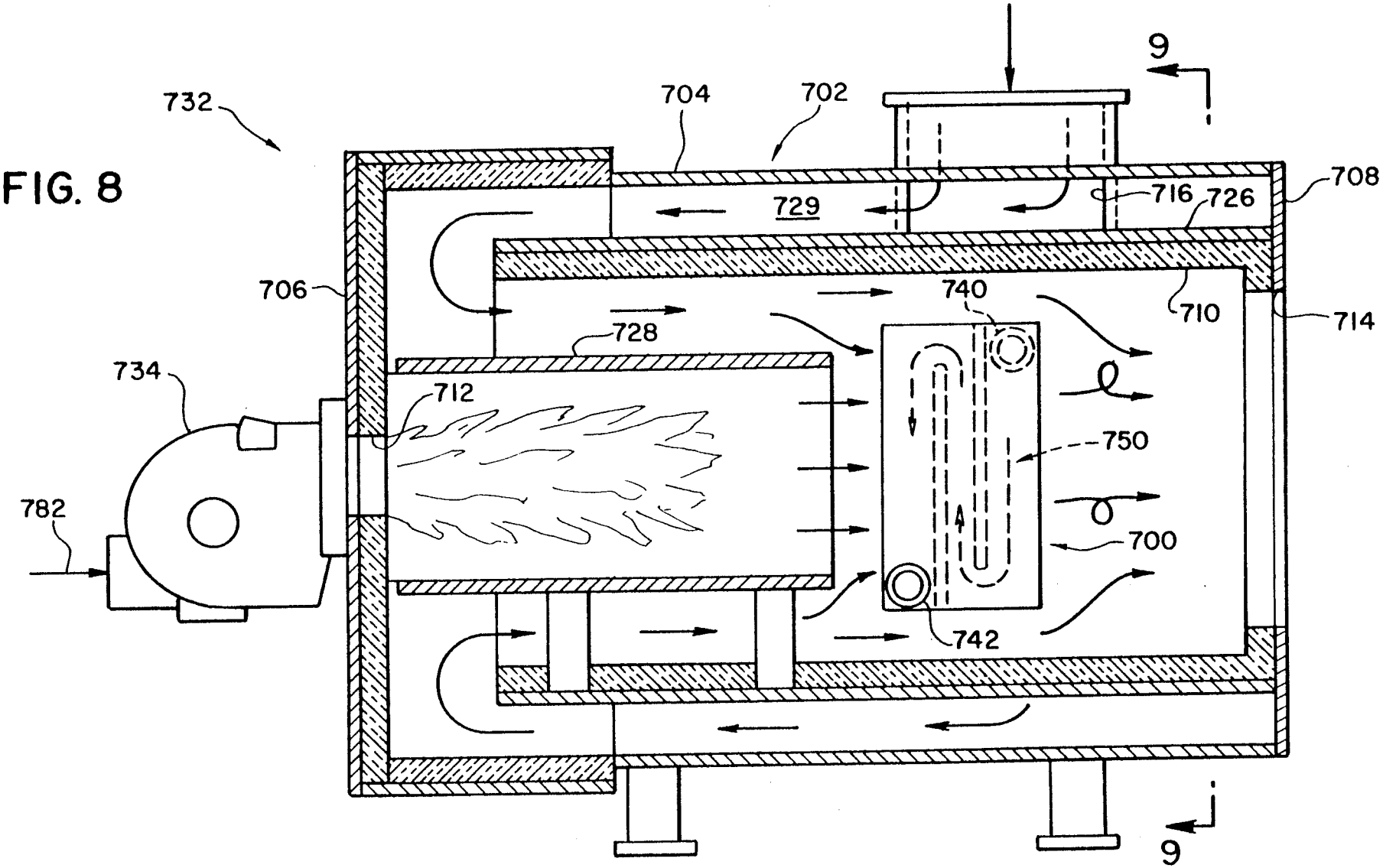
FIG. 8 is a longitudinal cross-sectional view of a third embodiment of a furnace with a burner coupled thereto in accordance with the invention using a special deodorizing chamber.

Furnace of FIGS. 8 and 9

A further embodiment of a furnace 732 is shown in FIGS. 8 and 9. Furnace 732 has a cylindrical housing 702 which includes a cylindrical outer side wall 704, a first end wall 706 and a second end wall 708.

First end wall 708 has a central, circular inlet opening 712 with burner 734 mounted thereto for receiving the flame end of burner 734 through opening 712. The second end wall 708 has a central, circular outlet opening 714 for discharging the hot air from furnace 732 to dryer 436. Side wall 704 has an exhaust air inlet 716 extending substantially tangentially thereto for continuously recycling exhaust air into furnace 732, and then to dryer 436 to dry the sludge.

The furnace 732 is also provided with a first cylindrical partition 726 and a second cylindrical partition 728. Cylindrical partitions 726 and 728 serve to direct the exhaust air entering into the furnace 732 past the flame of the burner 734, and then out through outlet opening 714 to dryer 436. In particular, the exhaust air stream to be recycled enters the furnace 732 through inlet 716, and then passes into a first tubular chamber 729 for directing the exhaust air towards end wall 706 where it is reflected at the end wall, and then passes along partition 728.

At the free end of partition 728, deodorizing chamber 700 is installed for mixing the burner air with the exhaust air stream to be recycled on the one hand, and for heating the exhaust air stream to be discharged to the environment on the other hand. Deodorizing chamber 700 includes an inlet pipe 740 and an outlet pipe 742 both extending substantially, radially through the walls of the furnace 732 and into chamber 700 as seen in FIG. 9. Also, chamber 700 includes either pipes or baffles for providing a passageway 750 between inlet pipe 740 and outlet pipe 742. The passageway 750 needs to be of sufficient length so that the exhaust air passing therethrough is heated to about 800° C. for about one to two seconds.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A furnace assembly for use with a sludge drying system, comprising:

a housing having an exhaust air chamber, a first inlet for providing recycled exhaust air into said exhaust air chamber, a first outlet for discharging hot exhaust air from said exhaust air chamber to a dryer, and a first passageway extending between said first inlet and said first outlet for passing the recycled exhaust air therethrough;

a burner coupled to said housing for producing a flame within said housing to heat said recycled exhaust air; and a deodorizing chamber for deodorizing off-gases to be discharged to the environment, and having a second inlet for providing the off-gases into said deodorizing chamber, a second outlet for discharging the off-gases from said deodorizing chamber to the environment, and a second passageway extending between said deodorizing chamber's inlet and said deodorizing chamber's outlet for maintaining the off-gases passing through said deodorizing chamber for a predetermined period of time, said second passageway being separate from said first passageway to maintain the off-gases to be discharged separate from the exhaust air to be recycled to the dryer;

said deodorizing chamber being coupled to said housing adjacent the flame produced by said burner to heat the off-gases passing through said deodorizing chamber.

2. A furnace assembly according to claim 1, wherein said deodorizing chamber surrounds the flame produced by said burner.

3. A furnace assembly according to claim 1, wherein said passageway of said deodorizing chamber is substantially tubular and surrounds the flame produced by said burner.

4. A furnace assembly according to claim 1, wherein said deodorizing chamber includes a cylindrical outer wall, a cylindrical inner wall concentric with said outer wall, and a baffle extending between said inner and outer walls.

5. A furnace assembly according to claim 4, wherein said baffle is substantially cylindrical for defining said passageway into inner and outer concentric tubes, which are fluidly coupled together.

6. A furnace assembly according to claim 5, wherein said deodorizing chamber's inlet is fluidly coupled to said inner tube of said passageway, and said deodorizing chamber's outlet is fluidly coupled to said outer tube of said passageway.

7. A furnace assembly according to claim 6, wherein said inner and outer tubes are fluidly coupled together at one of their ends, and said deodorizing chamber's inlet and outlet are fluidly coupled to the other ends of said inner and outer tubes.

8. A furnace assembly according to claim 1, wherein said housing is substantially cylindrical.

9. A furnace assembly according to claim 8, wherein said deodorizing chamber's inlet includes a duct extending substantially radially through said housing.

10. A furnace assembly according to claim 8, wherein said deodorizing chamber's outlet includes a duct extending substantially radially through said housing.

11. A furnace assembly according to claim 8, wherein said deodorizing chamber's inlet includes a duct extending substantially axially through said housing.

12. A furnace assembly according to claim 8, wherein said deodorizing chamber's outlet includes a duct extending substantially axially through said housing.

13. A furnace assembly according to claim 1, wherein said deodorizing chamber is positioned between the flame of said burner and said outlet of said housing.

14. A furnace assembly according to claim 13, wherein said passageway of said deodorizing chamber is defined by at least one baffle for impeding the flow of off-gases through said deodorizing chamber

15. A furnace assembly according to claim 14, wherein said housing includes a cylindrical outer wall, a first end with said burner coupled thereto, and a second end with said outlet of said housing coupled thereto.

16. A furnace assembly according to claim 15, wherein said housing further includes a first cylindrical partition extending from said second end of said housing.

17. A furnace assembly according to claim 16, wherein said inlet of said housing is positioned adjacent said second end so that said recycled exhaust air flows between said outer wall of said housing and said first partition towards said first end.

18. A furnace assembly according to claim 17, wherein said housing further includes a second partition extending from said first end of said housing towards said deodorizing chamber.

19. A sludge drying system for drying wet sludge to produce pellets of a predetermined size, comprising:

a furnace having an exhaust air chamber, a first inlet for providing recycled exhaust air into said exhaust air chamber, a first outlet for discharging hot exhaust air from said exhaust air chamber as system air to dry the sludge, and a first passageway extending between said inlet and said outlet for passing the recycled exhaust air through said exhaust air chamber;

a burner coupled to said furnace for producing a flame within said furnace to heat the recycled exhaust air;

a deodorizing chamber for deodorizing off-gases to be discharged to the environment, and having a second inlet for providing the off-gases into said deodorizing chamber, a second outlet for discharging the off-gases from said deodorizing chamber to the environment, and a second passageway extending between said second inlet of said deodorizing chamber and said second outlet of said deodorizing chamber for maintaining the off-gases passing through said deodorizing chamber for a predetermined period of time, said second passageway being separate from said first passageway to maintain the off-gases to be discharged separate from the exhaust air to be recycled as system air, and said deodorizing chamber being coupled to said furnace adjacent the flame produced by said burner to heat the off-gases passing through said deodorizing chamber;

a dryer fluidly coupled to said furnace's outlet for receiving the system air from said furnace, said drying including means for receiving the system air and wet sludge therein and means for discharging the system air and sludge pellets produced by said dryer from the wet sludge;

separating means, fluidly coupled to said dryer, for separating the system air from the sludge pellets; and dividing means, fluidly coupled to said separating means to receive the system air, for dividing the system air into two streams with one stream being fluidly coupled to said first inlet of said furnace and the other stream being fluidly coupled to said second inlet of said deodorizing chamber.

20. A sludge drying system according to claim 19, wherein said deodorizing chamber surrounds the flame produced by said burner.

21. A sludge drying system according to claim 19, wherein said passageway of said deodorizing chamber is substantially tubular and surrounds the flame produced by said burner.

22. A sludge drying system according to claim 19, wherein said deodorizing chamber includes a cylindrical outer wall, a cylindrical inner wall concentric with said outer wall, and a baffle extending between said inner and outer walls.

23. A sludge drying system according to claim 22, wherein said baffle is substantially cylindrical for defining said passageway into inner and outer concentric tubes, which are fluidly coupled together.

24. A sludge drying system according to claim 23, wherein said deodorizing chamber's inlet is fluidly coupled to said inner tube of said passageway, and said deodorizing chamber's outlet is fluidly coupled to said outer tube of said passageway.

25. A sludge drying system according to claim 24, wherein said inner and outer tubes are fluidly coupled together at one of their ends, and said deodorizing chamber's inlet and outlet are fluidly coupled to the outer ends of said inner and outer tubes.

26. A sludge drying system according to claim 19, wherein said furnace includes a substantially cylindrical housing with said first inlet and said first outlet coupled thereto.

27. A sludge drying system according to claim 26, wherein said second inlet includes a duct extending substantially radially through said housing.

28. A sludge drying system according to claim 26, wherein said second outlet includes a duct extending substantially radially through said housing.

29. A sludge drying system according to claim 26, wherein said second inlet includes a duct extending substantially axially through said housing.

30. A sludge drying system according to claim 26, wherein said second outlet includes a duct extending substantially axially through said housing.

31. A sludge drying system according to claim 19, wherein said deodorizing chamber is positioned between the flame of said burner and said first outlet of said furnace.

32. A sludge drying system according to claim 31, wherein said passageway of said deodorizing chamber is defined by at least one baffle for impeding the flow of off-gases through said deodorizing chamber.

33. A sludge drying system according to claim 32, wherein said furnace includes a housing having a cylindrical outer wall, a first end with said burner coupled thereto, and a second end with said first outlet of said furnace coupled thereto.

34. A sludge drying system according to claim 33, wherein said housing further includes a first cylindrical partition extending from said second end of said housing.

35. A sludge drying system according to claim 34, wherein said first inlet of said furnace is positioned adjacent said second end so that the recycled exhaust air flows between said outer wall of said housing and said first partition toward said first end.

36. A sludge drying system according to claim 35, wherein said housing further includes a second partition extending from said first end of said housing toward said deodorizing chamber.

* * * * *